US007361200B2

(12) United States Patent
Oh et al.

(10) Patent No.: US 7,361,200 B2
(45) Date of Patent: Apr. 22, 2008

(54) CYCLONE DUST SEPARATING APPARATUS AND VACUUM CLEANER HAVING THE SAME

(75) Inventors: Jang-keun Oh, Gwangju (KR); Jung-gyun Han, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 511 days.

(21) Appl. No.: 10/840,231

(22) Filed: May 7, 2004

(65) Prior Publication Data

US 2005/0050678 A1 Mar. 10, 2005

(30) Foreign Application Priority Data

Sep. 9, 2003 (KR) ..... 10-2003-0063212

(51) Int. Cl.
*B01D 45/12* (2006.01)

(52) U.S. Cl. ..... 55/343; 55/349; 55/418; 55/459.1; 55/DIG. 3; 15/350; 15/353

(58) Field of Classification Search ..... 55/343, 55/346, 349, 418, 429, 459.1, DIG. 3; 15/350, 15/353

See application file for complete search history.

(56) References Cited

U.S. PATENT DOCUMENTS

| | | | | |
|---|---|---|---|---|
| 1,207,034 A | | 12/1916 | Harsant | |
| 1,416,885 A | | 5/1922 | Schreiner | |
| 1,416,995 A | * | 5/1922 | Stroud | 55/343 |
| 2,511,387 A | | 6/1950 | Watson et al. | |
| 2,553,175 A | | 5/1951 | Davenport et al. | |
| 3,425,192 A | | 2/1969 | Davis | |
| 3,769,781 A | | 11/1973 | Klein et al. | |
| 4,373,228 A | | 2/1983 | Dyson | |
| 5,307,538 A | | 5/1994 | Rench et al. | |
| 6,238,451 B1 | | 5/2001 | Conrad et al. | |
| 6,334,234 B1 | | 1/2002 | Conrad et al. | |

(Continued)

FOREIGN PATENT DOCUMENTS

| | | |
|---|---|---|
| CN | 1389175 | 1/2003 |

(Continued)

OTHER PUBLICATIONS

Russian Patent Office, Office Action issued in connection with corresponding Application No. 2004121431.

(Continued)

*Primary Examiner*—Robert Hopkins
(74) *Attorney, Agent, or Firm*—Blank Rome LLP

(57) ABSTRACT

A cyclone dust separating apparatus and a vacuum cleaner with the same is disclosed. The cyclone dust separating apparatus includes a first cyclone for separating large dust particles from air, a plurality of second cyclones for separating minute dust particles from air via a centrifugal force after dust separation at the first cyclone, and a cover disposed on an upper portion of the first cyclone and the second cyclones. The cover includes a conical guide formed at a lower center to guide air discharged from the first cyclone into the second cyclones. Because drawn-in air is repeatedly cleaned by a plurality of cyclones, the cyclone dust separating apparatus can be provided with a compact structure, can provide an effective cleaning operation, and can prevent deterioration of a suction force.

17 Claims, 5 Drawing Sheets

U.S. PATENT DOCUMENTS

| | | | |
|---|---|---|---|
| 6,428,589 | B1 | 8/2002 | Bair et al. |
| 6,582,489 | B2 | 6/2003 | Conrad |
| 6,607,572 | B2 | 8/2003 | Gammack et al. |
| 6,740,144 | B2 | 5/2004 | Conrad et al. |
| 6,746,500 | B1 | 6/2004 | Park et al. |
| 2002/0066366 | A1 | 6/2002 | Conrad et al. |

FOREIGN PATENT DOCUMENTS

| | | | |
|---|---|---|---|
| CN | 1422187 | | 6/2003 |
| CN | 1434688 | | 8/2003 |
| DE | 28 11 536 | | 11/1978 |
| DE | 10132690 | | 7/2002 |
| DE | 10 2004 028 675 | | 6/2004 |
| DE | 10 2004 028 676 | | 6/2004 |
| DE | 10 2004 028 677.9 | | 6/2004 |
| FR | 2619498 | | 2/1989 |
| FR | 2619498 | A1 | 2/1989 |
| FR | 2859370 | | 3/2005 |
| GB | 835884 | | 5/1960 |
| GB | 1207034 | | 9/1970 |
| GB | 2360719 | | 3/2001 |
| GB | 2374305 | | 10/2002 |
| GB | 2377656 | | 1/2003 |
| GB | 2381484 | | 5/2003 |
| GB | 2375980 | | 8/2003 |
| GB | 2406065 | | 3/2005 |
| JP | 50-101012 | | 7/1975 |
| JP | 52-014775 | | 2/1977 |
| JP | 2002-051951 | | 2/2002 |
| JP | 2002-172077 | | 6/2002 |
| JP | 2002 326041 | | 11/2002 |
| JP | 2003-024826 | | 1/2003 |
| JP | 2003-116752 | | 4/2003 |
| WO | WO 00/44272 | | 9/1999 |
| WO | WO 01/74493 | | 10/2001 |
| WO | WO 01/95780 | A3 | 12/2001 |
| WO | WO 02/067750 | | 9/2002 |
| WO | WO-02/067756 | A1 | 9/2002 |
| WO | WO 03/030702 | | 4/2003 |

OTHER PUBLICATIONS

Chinese Patent Office, Office Action issued Jan. 6, 2006 with respect to Chinese Patent Application No. 200410049132.X filed on Jun. 17, 2004.

British Patent Office, Combined Search and Examination Report issued Oct. 29, 2004 with respect to British Patent Application No. 0413603.2 filed on Jun. 17, 2004.

Spanish Patent Office, State of the Art Report issued Mar. 16, 2006 with respect to Spanish Patent Application No. 200401731 filed on Jul. 15, 2004.

German Patent Office, Office Action issued Jul. 4, 2006 with respect to German Application No. 10 2004 028 676.0-15 filed on Jun. 14, 2004.

Japanese Patent Office, Office Action issued Jun. 20, 2006 with respect to Japanese Patent Application No. 2004-46393, filed Feb. 23, 2004.

German Patent Office, Office Action issued Jul. 11, 2006, with respect to German Patent Application No. 10 2004 028 678.7, filed Jun. 14, 2004.

Spanish Patent Office, State of the Art Report issued Apr. 17, 2006, with respect to Spanish Patent Application No. 200401753, filed Jul. 16, 2004.

Chinese Patent Office, Office Action issued Jan. 20, 2006, with respect to Chinese Patent Application No. 200410049219.7, filed Jun. 2, 2004.

British Patent Office, Combined Search and Examination Report issued Oct. 29, 2004, with respect to British Patent Application No. 0412903.7.

Russian Patent Office, Office Action issued May 13, 2005, with respect to Russian Patent Application No. 2004120073.

Korean Patent Office, Office Action issued Jul. 29, 2005, with respect to Korean Patent Application No. 2003-63211, filed Sep. 9, 2003.

Spanish Patent Office, State of the Art Report issued Apr. 19, 2006, with respect to Spanish Patent Application No. 200402015, filed Aug. 12, 2004.

German Patent Office, Office Action issued Jul. 4, 2006, with respect to German Patent Application No. 10 2004 028 677.9, filed Jun. 14, 2004.

Canadian Patent Office, Office Action issued Aug. 17, 2006, with respect to Canadian Patent Application No. 2,469,533.

French Patent Office, Preliminary Search Report issued Apr. 12, 2006, with respect to French Patent Application No. 0406487.

Russian Patent Office, Office Action issued May 13, 2005, with respect to Russian Patent Application No. 2004118404, filed Jun. 17, 2004.

Japanese Patent Office, Office Action issued Dec. 19, 2006 with respect to Japanese Patent Application No. 2004-51806, filed Feb. 26, 2004.

French Patent Office, Preliminary Search Report issued Feb. 22, 2007, with respect to French Patent Application No. 0406250, filed Jun. 9, 2004.

* cited by examiner

CYCLONE DUST SEPARATING APPARATUS AND VACUUM CLEANER HAVING THE SAME

REFERENCE TO RELATED APPLICATION

This application claims priority under 35 U.S.C. § 119, to Korean Patent Application No. 2003-63212, filed in the Korean Intellectual Property Office on Sep. 9, 2003, the entire contents of which are incorporated herein by reference.

CROSS-REFERENCE TO RELATED APPLICATIONS

This application is related to copending applications entitled "Cyclone Separating Apparatus and Vacuum Cleaner having the same" U.S. application Ser. No. 10/840,230, filed May 7, 2004,"Cyclone Separating Apparatus and Vacuum Cleaner Equipped with the same" U.S. application Ser. No. 10/840,248, filed May 7, 2004, and "Cyclone Separating Apparatus and a Vacuum Cleaner having the same" U.S. application Ser. No. 10/840,229, filed May 7, 2004, now U.S. Pat. No. 7,097,680, whose disclosures are commonly owned by the same assignee as the present application and are entirely incorporated herein by reference.

FIELD OF THE INVENTION

The present invention relates to a cyclone dust separating apparatus and a vacuum cleaner having the same, and more particularly, is related to a cyclone dust separating apparatus with a first cyclone and a plurality of second cyclones, in which at the lower center of an inflow/outflow cover connecting the first and the second cyclones, a conical guide is formed to guide a discharged air stream from the first cyclone to the second cyclones, and a vacuum cleaner with such a cyclone dust separating apparatus.

BACKGROUND OF THE INVENTION

Generally, a cyclone dust separating apparatus causes an air stream to whirl inside a cyclone chamber thereof, and uses the centrifugal force generated from the whirling air to separate dust from the drawn-in air. A vacuum cleaner with a typical example of the aforementioned cyclone dust separating apparatus is disclosed in U.S. Pat. Nos. 3,425,192 and 4,373,228, 3,425,192 and 4,373,228 disclose a cyclone dust collecting apparatus that separates and collects dust from the drawn-in air through the use of a plurality of cyclones. In the disclosed system, relatively large particles of dust are separated from air drawn-in the first cyclone. The once-filtered air-stream flows into the second cyclones or supplementary cyclones, where small particles of dust are separated from air. In particular, U.S. Pat. No. 3,425,192 discloses a cyclone system in which the supplementary cyclone is arranged at the upper portion of the first cyclone such that relatively large particles of dust are separated in the main cyclone, while partially cleaned air flows into the supplementary cyclone and is further cleaned. U.S. Pat. No. 4,373,228 discloses a cyclone system with a plurality of cyclone units. The cyclone system of U.S. Pat. No. 4,373,228 includes the supplementary cyclone inside the first cyclone. The conventional cyclone separating apparatuses as disclosed in U.S. Pat. Nos. 3,425,192 and 4,373,228 however, have numerous problems.

First, due to a rather complicated structure for connecting the first cyclone with the supplementary cyclone, a suction force generated at the main body of the vacuum cleaner may not be smoothly delivered, and as a result, cleaning efficiency deteriorates. Secondly, due to a bulky first cyclone and supplementary cyclone structure, the size of the cyclone separating apparatus using that system increases to maintain the same quality dust collecting performance. As the cyclone separating apparatus becomes bulky, the vacuum cleaner employing the cyclone separating apparatus also becomes bulky, and as a result, it is quite cumbersome for the user to keep or carry the vacuum cleaner. Thirdly, because the linking passage between the first cyclone and the supplementary cyclone is complex, which requires a large number of parts, the unit price increases.

Thus, a heretofore unaddressed need exists in the industry to address the aforementioned deficiencies and inadequacies.

SUMMARY OF THE INVENTION

The present invention has been developed in order to solve the above drawbacks and other problems associated with the prior art. An object of the present invention is to provide a cyclone dust separating apparatus which is capable of increasing dust collecting efficiency through a plurality of cyclone dust collecting units and also, prevent deterioration of a suction force using a compact structure, and a vacuum cleaner having the same.

The above objects and/or other features of the present invention are substantially realized by providing a cyclone dust separating apparatus of a vacuum cleaner, which comprises a first cyclone for separating dust from air, a plurality of second cyclones for separating minute dust particles from air by using a centrifugal force after dust separation at the first cyclone, and, a cover disposed on an upper portion of the first cyclone and the second cyclones. The cover includes a guide formed at a lower center to guide air discharged from the first cyclone into the second cyclones. The guide includes a conical shape. The cover comprises an air passage connecting the first cyclone with the second cyclones such that air discharged from the first cyclone is guided into smaller air streams in a radial pattern and flows into the second cyclones a fluid guide forms an outer part of the air passage.

The air passage extends from the conical guide in a radial pattern to connect to the second cyclones, respectively. The fluid guide is connected to the first cyclone and the second cyclones such that the fluid guide includes a linear part at a connection with the first cyclone, and a rounded part at a connection with the second cyclones to cause air to spin when entering the second cyclones. The cover further includes a plurality of discharge passages which penetrate through the cover to allow air from the second cyclones to be discharged therethrough. The cover is connected to the second cyclones such that a part of the discharge passages is inserted in the second cyclones, respectively, and air from the second cyclones is discharged through the discharge passage. One end of each of the discharge passages is connected to a second outlet formed at a side, and the other end of each of the discharge passages is open towards the upper portion of the cover.

The first cyclone includes a first chamber in which dust is separated from air by centrifugal force, a first inlet formed in the first chamber through which air and dust flows in, and, a first outlet formed in the first chamber through which air is discharged. The second cyclones each include a second chamber in which dust is further separated from air after dust separation at the first cyclone, a second inlet formed in the second chamber through which air flows in from the first cyclone, and, a second outlet formed in the second chamber through which dust-removed air is discharged out. The first chamber includes a cylindrical shape, and the second chamber includes a frustum-conical shape at a certain part. Further provided are a cyclone cover disposed on the upper portion of the cover, and a dust collecting unit detachably connected to the first cyclone and the second cyclones. The cyclone cover is conically shaped with open upper and lower spaces. The second cyclones are disposed on the outer circumference of the first cyclone in an enclosing manner, and, the first and the second cyclones are integrally formed with each other. The second cyclones are divided by a partition therebetween. According to an embodiment of the present invention, a vacuum cleaner includes a vacuum cleaner body for generating a suction force and drawing-in dust and air, a bottom brush for drawing-in dust from a bottom of the working area using the suction force wherein the bottom brush is in communication with the vacuum cleaner body, and a cyclone separating apparatus installed in the vacuum cleaner body. The cyclone separating apparatus includes a first cyclone for separating dust from air, a plurality of second cyclones for separating minute dust particles from air by using a centrifugal force after dust separation at the first cyclone, and, a cover disposed on an upper portion of the first cyclone and the second cyclones. The cover includes a guide formed at a lower center to guide air discharged from the first cyclone into the second cyclones. The guide is preferably conically shaped. Other systems, methods, features, and advantages of the present invention will be or become apparent to one skilled in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The above aspects and other features of the present invention will become more apparent by describing in detail certain embodiments thereof with reference to the attached drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

Figure 1:
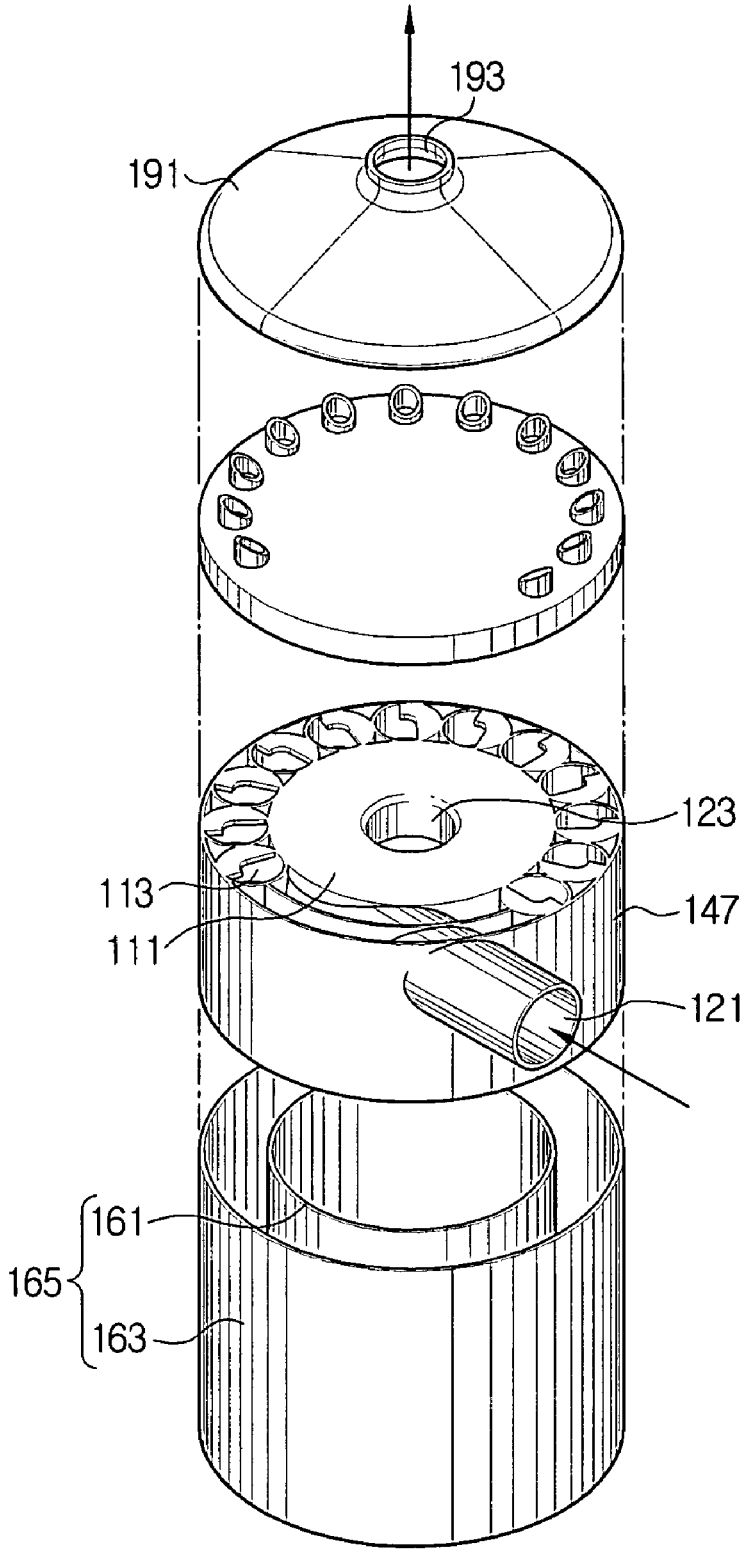
FIG. 1 is a drawing of an exploded perspective view of the main part of a cyclone dust separating apparatus according to an embodiment of the present invention.

A cyclone dust separating apparatus according to an embodiment of the present invention includes a first cyclone 111, a plurality of second cyclones 113, a cover 190 mounted on the upper portion of the first cyclone 111 and the second cyclones 113 to allow entrance and exit of the cyclones 111 and 113, a cyclone cover 191 and a dust collecting unit 165. The second cyclones 113 are disposed on the outer circumference to the first cyclone 111 in an enclosing manner.

Figure 3:
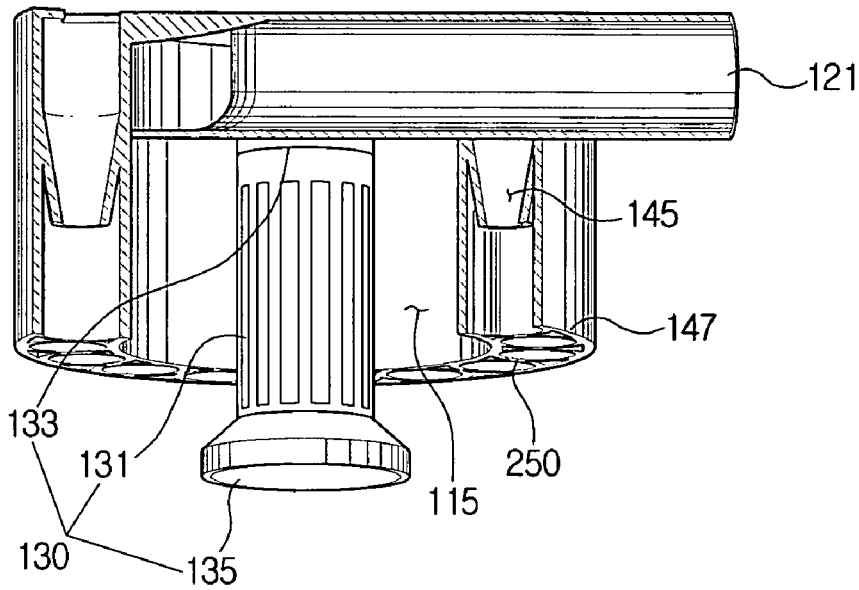
FIG. 3 is a drawing of a partially-cut sectional and perspective view of a cyclone dust separating apparatus according to an embodiment of the present invention.
Figure 4:
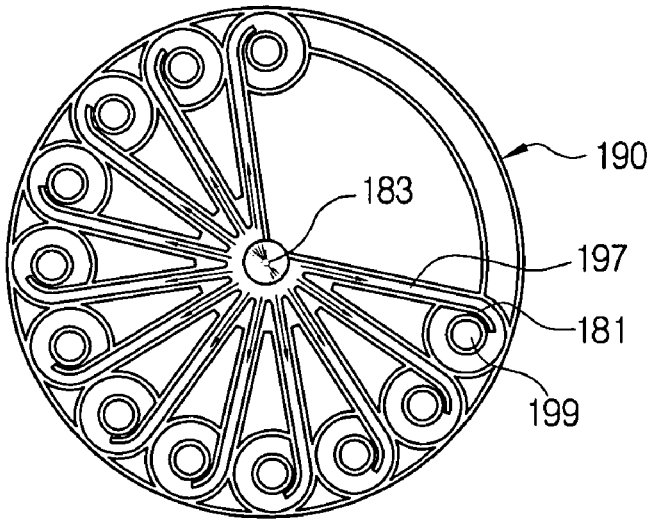
FIG. 4 is a drawing of a bottom view of a cover for entrance and exit of a cyclone dust separating apparatus according to an embodiment of the present invention.

The first and the second cyclones 111 and 113 are formed integrally with each other, and a partition 250 is disposed between the second cyclones 113 (see FIG. 3). The partition 250 divides the space between the second cyclones 113, and the overall structure of the cyclone dust separating apparatus 100 is reinforced.

Figure 5:
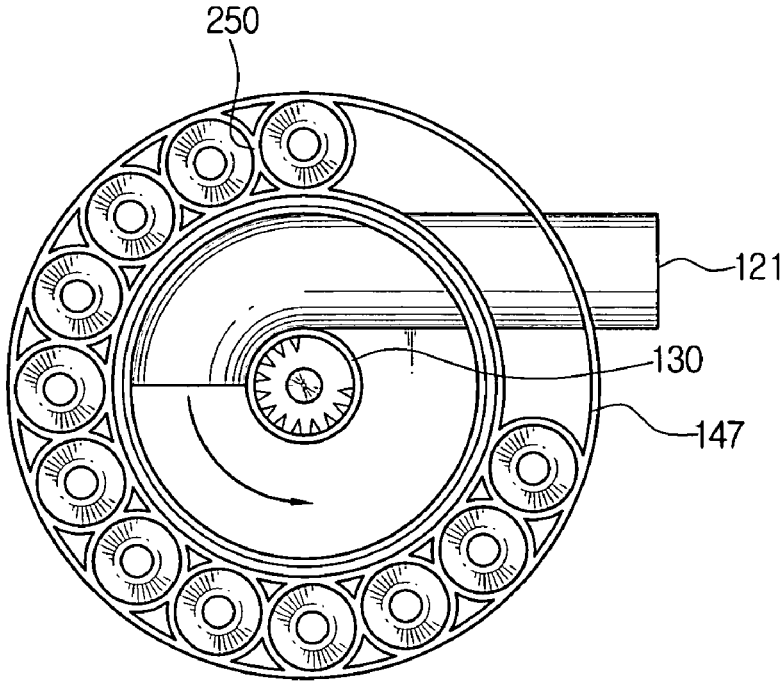
FIG. 5 is a drawing of a bottom view of a first cyclone and a second cyclone of a cyclone dust separating apparatus according to an embodiment of the present invention.

A cylindrical chamber wall 147 is formed around the second cyclones 113. The chamber wall 147 may take various configurations, such as a polygon, and depend upon the structure of accommodating the vacuum cleaner main body 10 (see FIGS. 5 and 6).

The first cyclone 111 includes a first chamber 115, a first inlet 121, a first outlet 123 and a grill member 130. The first chamber 115 is formed in a cylindrical, or substantially cylindrical shape, and dust-ladened air is swirled into fast-spinning air in the first chamber 115 to obtain a centrifugal effect. The grill member 130 is disposed at the upper stream side of the first outlet 123, to prevent dust or contaminants separated from air from flowing back through the first outlet 123. The grill member 130 includes a grill body 131 with a plurality of fluid passages, a grill opening 133 and a sealing member 135. The grill opening 133 is formed in a side of the grill body 131 in fluid-communication manner so that clean air can be discharged therethrough. The sealing member 135 is formed at the other side of the grill body 131 to prevent dust contaminants separated from air from flowing back.

The second cyclones 113 each comprise a second chamber 145, a second inlet 141 and a second outlet 143. The second chamber 145 includes a frustum-conical end. Dust and contaminants are separated from air by a centrifugal effect in the second chamber 145. Air discharged from the first cyclone 111 flows in through the second inlet 141, and air, which has been cleaned by the centrifugal effect in the second chamber 145, is discharged out through the second outlet 143.

The cover 190 is disposed on the upper portion of the first cyclone 111 and the second cyclones 113. The cover 190 includes an air passage 197 which connects the outlet 123 of the first cyclone 111 with the second inlet 141 of the second cyclone 113 in a fluid-communicating manner, and a fluid guide 181 which forms the discharge passage 199 and the outer side portion of the fluid passage 197. A conical guide 183 is formed at the lower center of the cover 190 to guide air discharging from the first cyclone 111 into the second cyclones 113. It should be noted that the shape of the conical guide 183 can be changed. In other words, the conical guide 183 may take other shapes, such as a frustum-cone, so long as the conical guide 183 ensures that the suction force deterioration of air discharged from the first cyclone 111 is prevented, and an air stream is efficiently guided into the second cyclones 113.

The air passages 197 extends from the conical guide 183 to the second cyclones 113 in a radial pattern respectively, such that air from the first cyclone 111 is radially guided to the second cyclones 113 in smaller streams. The fluid guide 181 is connected to the first cyclone 111 and the second cyclones 113. The fluid guide 181 includes a linear shape at the connection with the first cyclone 111, and a rounded shape at the connection with the second cyclones 113. The discharge passage 199 is in fluid-communication with the second outlet 143 of the second cyclones 113 and is formed to insert into the second outlet 143 of the cover 190.

Accordingly, when the cover 190 is connected to the second cyclones 113, a part of the discharge passage 199 is inserted into the second outlet 143 to permit clean air to pass through the discharge passage 199. One end of the discharge passage 199 is connected to the second outlet 143 of the second cyclones 113, and the other end is open towards the upper portion of the cover 190. The cyclone cover 191 is formed as a cone, or substantially a cone, which is open at upper and lower spaces. The cyclone cover 191 is detachably disposed on the upper portion of the cover 190. When air discharged from the second cyclones 113 through the second outlet 143 accumulates, air is discharged out of the cyclone dust separating apparatus 100 through the upper opening 193 which is formed in an upper space of the cyclone cover 191.

The dust collecting unit 165 includes a first dust receptacle 161 and a second dust receptacle 163. The first and the second dust receptacles 161, 163 respectively, are integrally formed with each other. The second dust receptacle 163 includes a cylindrical, or substantially cylindrical shape, and is hollow inside. The second dust receptacle 163 is detachably connected to the chamber wall 147 formed on the outer side of the second cyclones 113. The first dust receptacle 161 includes a cylindrical, or substantially cylindrical shape, and is hollow inside. The first dust receptacle 161 is disposed inside the second dust receptacle 163, and is detachably connected to the first chamber 115 of the first cyclone 111.

Figure 6:
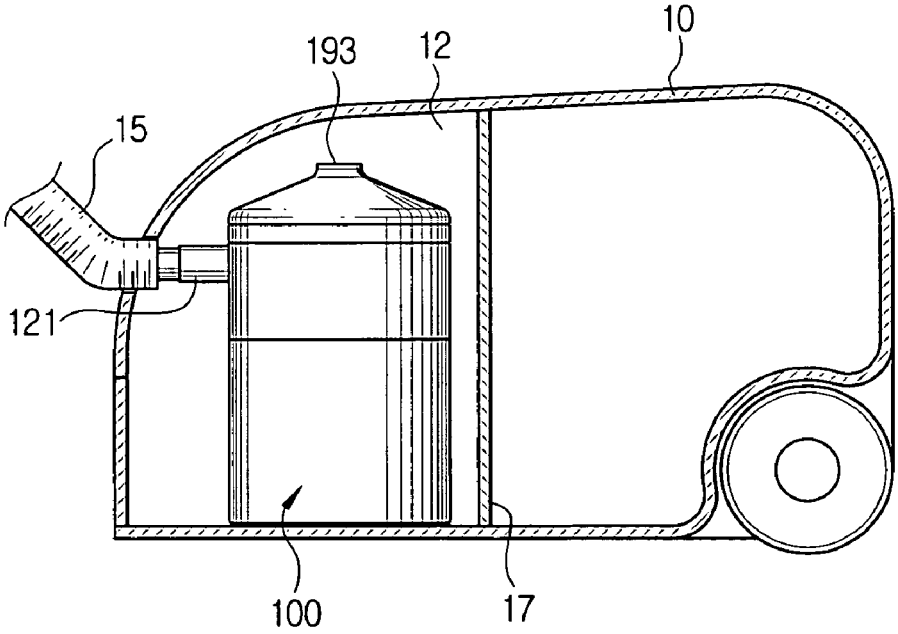
FIG. 6 is a drawing of a schematic sectional view of a cyclone dust separating apparatus adapted to a canister type vacuum cleaner according to an embodiment of the present invention.

As shown in FIG. 6, a partition 17 is disposed inside the vacuum cleaner body 10, defining a dust chamber 12 at a certain side of the interior space of the vacuum cleaner body 10. The dust chamber 12 accommodates the cyclone dust separating apparatus 100. The first inlet 121 is formed on the outer surface and at an upper side of the cyclone dust separating apparatus 100. When the suction force is generated by the operation of a motor (not shown), air and dust from the cleaning surface is drawn-in into the cyclone dust separating apparatus 100 through the first inlet 121. The upper opening 193 is formed in the upper center of the cyclone dust separating apparatus 100, so that air cleaned by the centrifugal force of the spinning air, is discharged upward through the upper opening 193.

Figure 7:
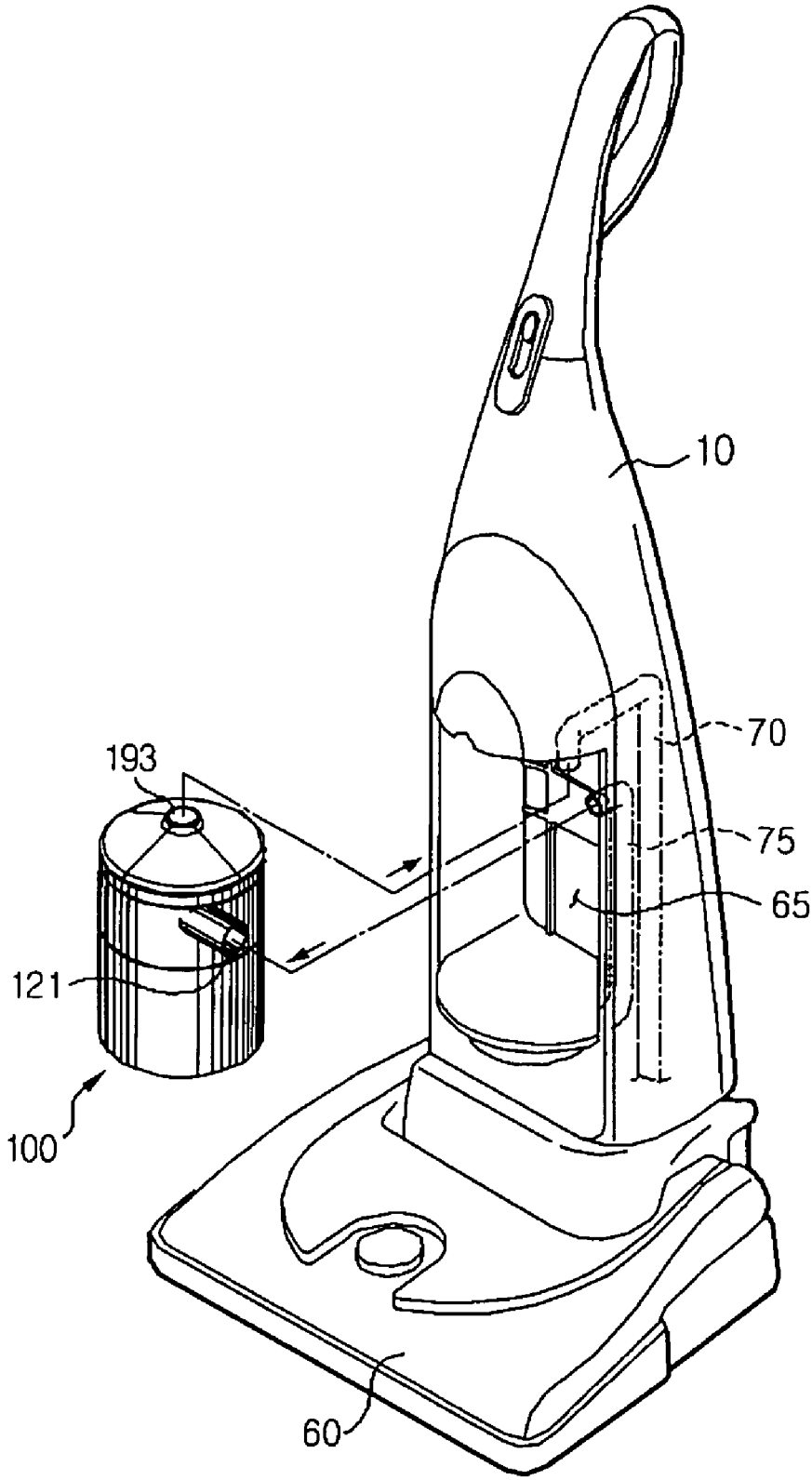
FIG. 7 is a drawing of a schematic perspective view of a cyclone dust separating apparatus according to an embodiment of the present invention adapted to an upright-type vacuum cleaner.

The cyclone dust separating apparatus 100 is applicable not only to the canister type vacuum cleaner, but also to the upright type vacuum cleaner. FIG. 7 shows an example where the cyclone dust separating apparatus 100 is applied to the upright type vacuum cleaner, and is described in detail below.

A motor driving part (not shown) is provided inside the vacuum cleaner body 10 as a vacuum generator. Additionally, a suction brush 60 is movably connected to the lower side of the cleaner body 10. A cyclone mounting part 65 is provided to the middle portion of the front side of the cleaner body 10. An air suction passage 70 in fluid-communication with the suction brush 60, and an air discharge passage 75 in fluid-communication with the motor driving part (not shown), are provided at the inner side of the cyclone mounting part 65, respectively.

The first inlet 121 of the cyclone dust separating apparatus 100 is in fluid-communication with the air suction passage 70, and the upper opening 193 is in fluid-communication with the air discharge passage 75. Accordingly, dust-ladened air is drawn-in through the suction brush 60, and, after the removal of dust from drawn-in air along the cyclone dust separating apparatus 100, the cleaned air is passed through the upper opening 193 and the air discharge passage 75, and discharged out.

When a suction force is generated, air and dust is drawn into the vacuum cleaner body 10 through a bottom brush 60 which is in fluid-communication with the vacuum cleaner body 10. The drawn-in air and dust flows into the first chamber 115 through the first inlet 121 of the cyclone dust separating apparatus 100 in a tangential relation with respect to the first chamber 115. Dust is separated from the drawn-in air in the first cyclone 111, and separated dust and contaminant is collected in the first dust receptacle 161. Dust-ladened air is drawn into the first cyclone 111 by the suction force generated at the vacuum cleaner body 10 and dust is separated in the first cyclone 111. More specifically air flows into the first chamber 115 of the first cyclone 111 through the first inlet 121, and is swirled along the inner wall of the first chamber 115 in a tangential relation with respect to the first chamber 115. Accordingly, air fast-spins, generating a centrifugal force.

Because relatively lighter particles are influenced more by the centrifugal force, the smaller and lighter contaminants gather toward the center of the first chamber and are discharged in a stream which leads toward the first outlet 123. Relatively heavier particles of contaminants are discharged through the first outlet 123 of the first chamber 115, passed through the air passages 197, and flow into the second chamber 145 through the second inlet 141 of the second cyclones 113.

Because the air passages 197 extend from the center of the cover 190 in a radial pattern, a single air-stream is divided into a plurality of smaller air streams, which enables a more efficient air separating operation at the second cyclones 113. More specifically, air from the first cyclone 111 is branched into smaller air streams which partially spins when passing through the conical guide 183 at the lower center of the cover 190, and the smaller air streams are drawn into the second cyclones via the air passages 197 which are fluidly connected with the conical guide 183.

Figure 2:
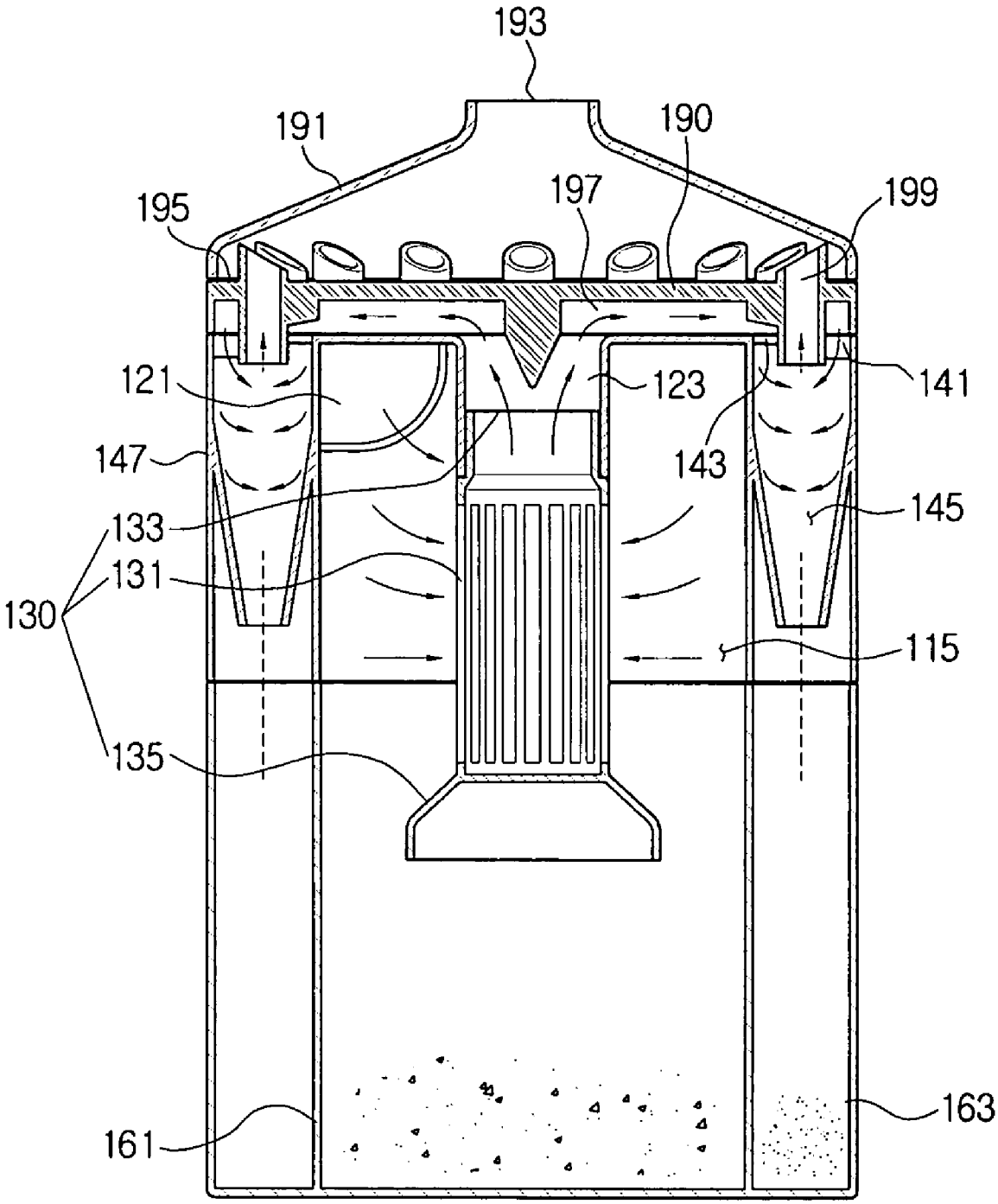
FIG. 2 is a drawing of sectional view of a cyclone dust separating apparatus according to an embodiment of the present invention.

Because the fluid guides 181 which form the outer side of the air passages 197 are rounded at the connecting parts between the air passages 197 and the second cyclones 113, incoming air is formed into spiraling air when it enters into the second cyclones 113. As a result, a larger centrifugal force is obtained, and deterioration of the suction force is prevented. Air is further cleaned in the second chamber 145 by the centrifugal force. Smaller particles of contaminants are collected in the second dust receptacle 163. Minute dust particles are separated in the second cyclones 113 and collected in the second dust receptacle 163. The partition 250 formed between the second cyclones 113 prevents dust from flowing back, and also facilitates the collecting of dust when separated dust is dropped into the second dust receptacle 163. After dust is separated, clean air accumulates at the cyclone cover 191 through the second outlet 143 of the second cyclone 113 and the discharge passage 199 of the cover 190, and is discharged out through the upper opening 193 formed in the upper portion of the cyclone cover 191 (see FIG. 2).

In other words, air which is first cleaned in the first cyclone 111, is again cleaned in the second cyclones 113, and relatively smaller particles of dust are removed in the second cyclones 113. Because drawn-in air is cleaned in the first cyclone 111 for removing large particle dust, and again cleaned in a plurality of second cyclones 113 for smaller particle dust, the cyclone dust separating apparatus 100 provides an effective cleaning operation.

In the cyclone dust separating apparatus 100 as described above with reference to certain embodiment of the present invention, a connecting distance between the first and the second cyclones 111 and 113 is short. Furthermore, the cover 190, which is connected with the first and the second cyclones 111 and 113, prevents deterioration of the suction force and facilitates air flow, and also increases dust collecting efficiency because incoming air to the second cyclones 113 forms a spinning air current. When air is discharged from the cyclone dust separating apparatus 100, air flows through the vacuum cleaner body 10 and is discharged outside.

The conventional cyclone dust separating apparatuses used to have limited dust collecting efficiency, or even worse, deterioration in dust collecting operation. However, with the dust separating apparatus as described above, the cover enables a compact connection structure between the first and the second cyclones and prevents deterioration of the suction force. As a result, dust collecting efficiency increases.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A cyclone dust separating apparatus of a vacuum cleaner, comprising:

a first cyclone for separating dust from air;

a plurality of second cyclones for separating minute dust particles from air by using a centrifugal force after the dust separation at the first cyclone; and a cover disposed on an upper portion of the first cyclone and the second cyclones, the cover including a guide formed at a lower center to guide air discharged from the first cyclone into the second cyclones.

2. The cyclone dust separating apparatus of claim 1, wherein the guide includes a conical shape.

3. The cyclone dust separating apparatus of claim 2, wherein the cover comprises:

an air passage connecting the first cyclone with the second cyclones such that air discharged from the first cyclone is guided into smaller air-streams in a radial pattern and flows into the second cyclones; and a fluid guide for forming an outer part of the air passage.

4. The cyclone dust separating apparatus of claim 3, wherein the air passage is extended from the conical guide in a radial pattern to connect to the second cyclones, respectively.

5. The cyclone dust separating apparatus of claim 4, wherein the fluid guide is connected with the first cyclone and the second cyclones such that the fluid guide includes a linear part at a connection with the first cyclone, and a rounded part at a connection with the second cyclones to cause air to spin upon entering the second cyclones.

6. The cyclone dust separating apparatus of claim 5, wherein the cover further comprises a plurality of discharge passages which penetrate through the cover to allow air from the second cyclones to be discharged therethrough.

7. The cyclone dust separating apparatus of claim 6, wherein the cover is connected to the second cyclones such that a part of the discharge passages is inserted in the second cyclones, respectively, and air from the second cyclones is discharged through the discharge passage.

8. The cyclone dust separating apparatus of claim 7, wherein one end of each of the discharge passages is connected to a second outlet formed at a side, and the other end of each of the discharge passages is open towards the upper portion of the cover.

9. The cyclone dust separating apparatus of claim 3, wherein the first cyclone comprises:

a first chamber in which dust is separated from air by centrifugal force;

a first inlet formed in the first chamber through which air and dust flows in; and a first outlet formed in the first chamber, through which air is discharged.

10. The cyclone dust separating apparatus of claim 9, wherein the second cyclones each comprise:

a second chamber in which dust is further separated from air after dust separation at the first cyclone;

a second inlet formed in the second chamber, through which air flows in from the first cyclone; and a second outlet formed in the second chamber, through which dust-removed air is discharged out.

11. The cyclone dust separating apparatus of claim 10, wherein the first chamber is, or substantially is cylindrically shaped, and the second chamber includes a frustum-conical shape at a certain part.

12. The cyclone dust separating apparatus of claim 3, further comprising:

a cyclone cover disposed on the upper portion of the cover; and a dust collecting unit detachably connected to the first cyclone and the second cyclones.

13. The cyclone dust separating apparatus of claim 12, wherein the cyclone cover includes a conical shape with open upper and lower spaces.

14. The cyclone dust separating apparatus of claim 3, wherein the second cyclones are disposed on the outer circumference of the first cyclone in an enclosing manner, and the first and the second cyclones are integrally formed with each other.

15. The cyclone dust separating apparatus of claim 14, wherein the second cyclones are divided by a partition therebetween.

16. A vacuum cleaner, comprising:

a vacuum cleaner body for generating a suction force and drawing-in dust and air;

a bottom brush for drawing-in dust from a bottom of the working area using the suction force, the bottom brush in fluid-communication with the vacuum cleaner body; and a cyclone separating apparatus installed in the vacuum cleaner body, wherein the cyclone separating apparatus comprises:

a first cyclone for separating dust from an air;

a plurality of second cyclones for separating minute dust particles from air via a centrifugal force after dust separation at the first cyclone; and a cover disposed on an upper portion of the first cyclone and the second cyclones, the cover including a guide formed at a lower center to guide air discharged from the first cyclone into the second cyclones.

17. The vacuum cleaner of claim 16, wherein the guide includes a conical shape.

* * * * *